US008344234B2

(12) United States Patent
Sugai

(10) Patent No.: US 8,344,234 B2
(45) Date of Patent: Jan. 1, 2013

(54) TEMPO DETECTING DEVICE AND TEMPO DETECTING PROGRAM

(75) Inventor: Ichiro Sugai, Kawasaki (JP)

(73) Assignee: Pioneer Corporation, Kawasaki-shi (JP)

( * ) Notice: Subject to any disclaimer, the term of this patent is extended or adjusted under 35 U.S.C. 154(b) by 228 days.

(21) Appl. No.: 12/937,436

(22) PCT Filed: Apr. 11, 2008

(86) PCT No.: PCT/JP2008/057129

§ 371 (c)(1),
(2), (4) Date: Nov. 22, 2010

(87) PCT Pub. No.: WO2009/125489

PCT Pub. Date: Oct. 15, 2009

(65) Prior Publication Data

US 2011/0067555 A1 Mar. 24, 2011

(51) Int. Cl.
*G10H 1/00* (2006.01)

(52) U.S. Cl. ..... 84/612; 84/636; 84/652; 84/668

(58) Field of Classification Search ..... 84/612, 84/636, 652, 668

See application file for complete search history.

(56) References Cited

U.S. PATENT DOCUMENTS 4,089,246 A * 5/1978 Kooker ..... 84/470 R
4,300,225 A * 11/1981 Lambl ..... 369/2
4,361,066 A * 11/1982 Jones ..... 84/636
4,542,675 A * 9/1985 Hall et al. ..... 84/668
5,256,832 A * 10/1993 Miyake ..... 84/636
5,614,687 A * 3/1997 Yamada et al. ..... 84/662
6,316,712 B1 * 11/2001 Laroche ..... 84/636
6,323,412 B1 * 11/2001 Loo ..... 84/636
6,787,689 B1 * 9/2004 Chen ..... 84/600
7,132,595 B2 * 11/2006 Lu et al. ..... 84/612
7,183,479 B2 * 2/2007 Lu et al. ..... 84/612
7,534,951 B2 * 5/2009 Yamashita ..... 84/611
7,579,546 B2 * 8/2009 Sumita ..... 84/611
7,582,824 B2 * 9/2009 Sumita ..... 84/612
7,615,702 B2 * 11/2009 Becker et al. ..... 84/612
7,645,929 B2 * 1/2010 Chang et al. ..... 84/612
7,767,897 B2 * 8/2010 Jochelson et al. ..... 84/609
7,923,621 B2 * 4/2011 Shiraishi et al. ..... 84/612
8,071,869 B2 * 12/2011 Chen et al. ..... 84/612

(Continued)

FOREIGN PATENT DOCUMENTS

JP 5-27751 2/1993

(Continued)

OTHER PUBLICATIONS

International Search Report for PCT/JP2008/057129, mailed May 20, 2008.

*Primary Examiner* — David S. Warren
(74) *Attorney, Agent, or Firm* — Nixon & Vanderhye PC

(57) ABSTRACT

A tempo detecting device 100 includes an envelope detecting means 1 that detects an envelope of musical composition data, a frequency-component detecting means 2 that performs a discrete Fast Fourier Transform processing on the detected envelope to thereby detect a frequency spectrum, and a tempo detecting means 3 that detects, based on a characteristic of the detected frequency spectrum, a tempo of the musical composition data.

15 Claims, 7 Drawing Sheets

U.S. PATENT DOCUMENTS

| | | | | |
|---|---|---|---|---|
| 8,076,566 | B2 * | 12/2011 | Yamashita et al. | 84/611 |
| 2004/0068401 | A1 | 4/2004 | Herre et al. | |
| 2004/0069123 | A1 * | 4/2004 | Becker et al. | 84/612 |
| 2005/0092165 | A1 * | 5/2005 | Weare et al. | 84/668 |
| 2005/0211072 | A1 * | 9/2005 | Lu et al. | 84/612 |
| 2005/0217463 | A1 | 10/2005 | Kobayashi | |
| 2006/0048634 | A1 * | 3/2006 | Lu et al. | 84/612 |
| 2006/0060067 | A1 * | 3/2006 | Lu et al. | 84/612 |
| 2006/0185501 | A1 * | 8/2006 | Shiraishi et al. | 84/612 |
| 2007/0022867 | A1 * | 2/2007 | Yamashita | 84/612 |
| 2007/0180980 | A1 * | 8/2007 | Kim | 84/612 |
| 2008/0034948 | A1 * | 2/2008 | Sumita | 84/636 |
| 2008/0060505 | A1 * | 3/2008 | Chang et al. | 84/612 |
| 2008/0115656 | A1 * | 5/2008 | Sumita | 84/612 |
| 2008/0276793 | A1 * | 11/2008 | Yamashita et al. | 84/611 |
| 2009/0019994 | A1 * | 1/2009 | McKinney | 84/612 |
| 2009/0056526 | A1 * | 3/2009 | Yamashita et al. | 84/611 |
| 2009/0114081 | A1 | 5/2009 | Kobayashi | |
| 2010/0011941 | A1 * | 1/2010 | Becker et al. | 84/612 |
| 2010/0017034 | A1 * | 1/2010 | Nakadai et al. | 700/258 |
| 2010/0251877 | A1 * | 10/2010 | Jochelson et al. | 84/609 |
| 2010/0282045 | A1 * | 11/2010 | Chen et al. | 84/612 |
| 2010/0300271 | A1 * | 12/2010 | Attias et al. | 84/612 |
| 2011/0067555 | A1 * | 3/2011 | Sugai | 84/612 |
| 2012/0024130 | A1 * | 2/2012 | Takahashi et al. | 84/612 |

FOREIGN PATENT DOCUMENTS

| | | |
|---|---|---|
| JP | 8-201542 | 8/1996 |
| JP | 2004-528596 | 9/2004 |
| JP | 2005-274708 | 10/2005 |
| JP | 2006-194953 | 7/2006 |
| WO | WO 02/093557 | 11/2002 |
| WO | WO 2007/138812 | 12/2007 |

* cited by examiner

TEMPO DETECTING DEVICE AND TEMPO DETECTING PROGRAM

This application is the U.S. national phase of International Application No. PCT/JP2008/057129 filed 11 Apr. 2008, which designated the U.S., the entire contents of which is hereby incorporated by reference.

TECHNICAL FIELD OF THE INVENTION

The present invention relates to tempo detecting devices and tempo detecting programs for detecting the tempo of musical compositions.

BACKGROUND ART

Recently, a method of retrieving desired musical composition data from many items of musical composition data stored in a high-capacity storage means, such as a hard disk, and playing back the music has been popular. Such retrieving of musical composition data can use bibliographic data, such as the artist names, the song titles, and the like, as retrieval data, and, in addition to the bibliographic data, the emotions of musical compositions, such as up-tempo songs and slow-tempo songs. This detects the features of musical compositions from musical composition data, and retrieves musical composition data by matching the detected features with the emotions of musical compositions.

Tempos are one of the features that can be matched with the emotions of musical compositions. Because the tempo is an important parameter of a musical composition, various detecting methods have been proposed.

For example, a first patent document discloses a technology that measures a peak interval between the amplitudes, each of which has with a predetermined frequency component, in a music signal to thereby detect the tempo.

In addition, for example, a second patent document obtains correlations among level changes in a music signal at preset intervals, and seeks the time interval with the highest correlation function to thereby detect the tempo.

In addition to the methods for detecting the tempo by analyzing a music signal in the time domain, methods for detecting the tempo by analyzing a music signal in the frequency domain are disclosed.

For example, a third patent document discloses a technology that performs a Fast Fourier transform on a music signal in a micro section to obtain average power, and performs a Fast Fourier transform on time-series data of the average power to calculate a power spectrum. Then, the technology detects the tempo based on the difference between the calculated power spectrum and an approximate line of the power spectrum.

First patent document: Japanese Patent Laid-Open No. H8-201542

Second patent document Japanese Patent Laid-Open No. H5-27751

Third patent document Japanese Patent Laid-Open No. 2006-194953

DISCLOSURE OF THE INVENTION

Problems to be Solved by the Invention

The method for measuring a peak interval between the amplitudes, each of which has with a predetermined frequency component, in a music signal to thereby detect the tempo, as described in the first patent document, is simple in its processing. However, the method may frequently result in false detecting for musical compositions with a weak beat or those containing an irregular signal so that it cannot accurately detect the tempo. That is, this method is effective for musical compositions with a strong beat, such as dance music songs, but it is difficult for this music to accurately detect the tempo for musical compositions with a weak beat, such as pop songs.

The method for detecting the tempo based on the correlation function, as described in the second patent document, can accurately detect the tempo. However, because the method requires a large amount of calculation in order to detect the tempo with high accuracy, the method is difficult to be installed in products.

The method that frequently uses a Fast Fourier transform to analyze a music signal in the frequency domain using frequent, thus detecting the tempo, as described in the third patent document, also requires a large amount of calculation. This makes it difficult for the method to be installed in products.

In addition, each of these methods does not consider the beat of music compositions, making it difficult to detect that they have, for example, a three-four beat or a six-eight beat.

The present invention has been made in view of the aforementioned circumstances, and has an example of a purpose of providing tempo detecting devices and tempo detecting programs, which are capable of detecting the tempo of musical compositions with high accuracy independently of the types of the musical compositions and having a light load for high-accuracy detection with a certain level of installability.

Means for Solving the Problems

In order to achieve such a purpose provided above, a tempo detecting device according to an invention recited in one aspect of the present invention includes an envelope detecting means that detects an envelope of musical composition data, a frequency-component detecting means that performs a discrete Fast Fourier Transform processing on the detected envelope to thereby detect a frequency spectrum, and a tempo detecting means that detects, based on a characteristic of the detected frequency spectrum, a tempo of the musical composition data.

A program for detecting a tempo of musical composition data according to an invention recited in another aspect of the present invention, the program being configured to cause a computer to execute an envelope detecting step that detects an envelope of musical composition data, a frequency-component detecting step that performs a discrete Fast Fourier Transform processing on the detected envelope to thereby detect a frequency spectrum, and a tempo detecting step that detects, based on a characteristic of the detected frequency spectrum, a tempo of the musical composition data.

DESCRIPTION OF CHARACTERS

Figure 1:
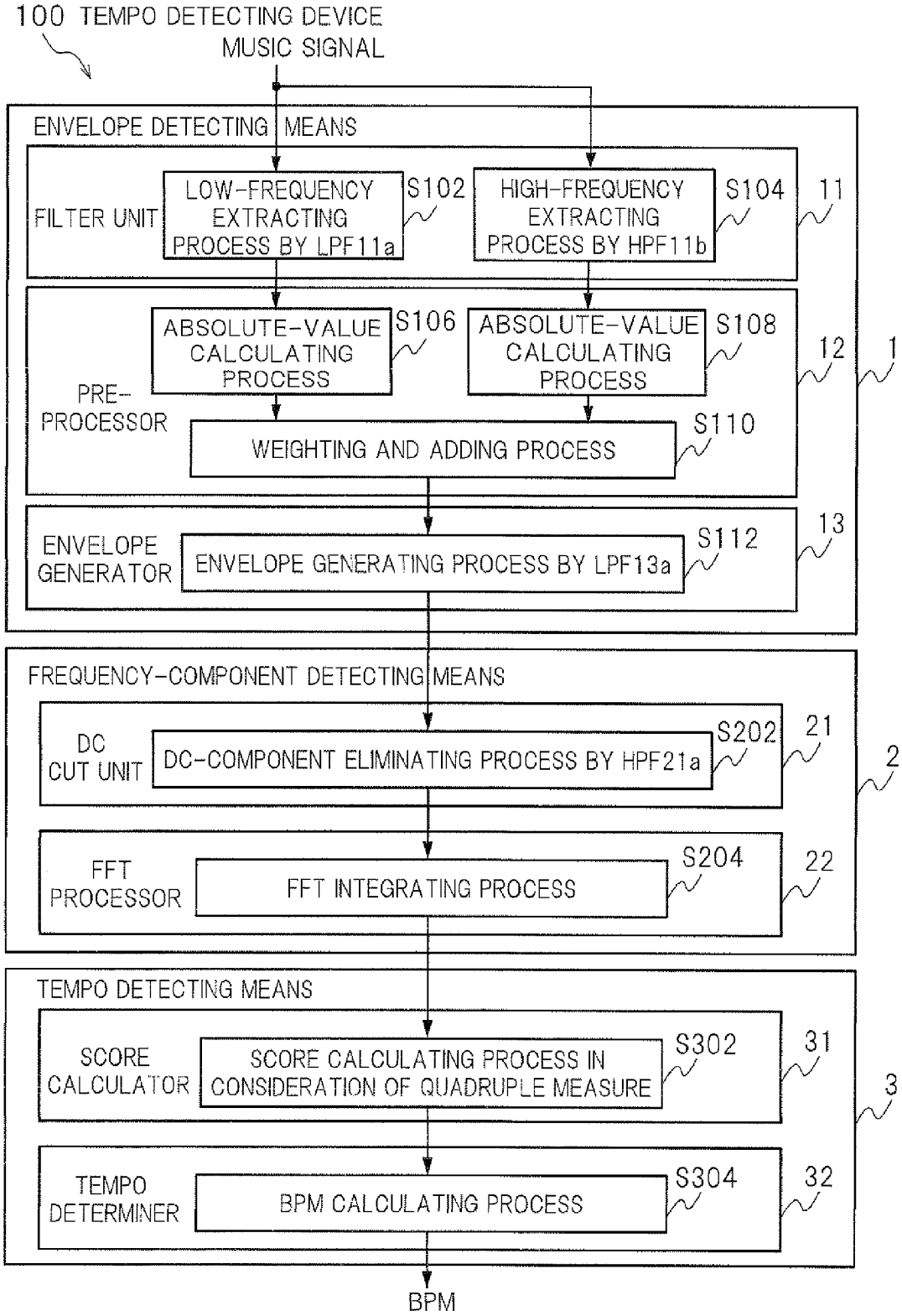
FIG. 1 is a schematic structural view of a tempo detecting device according to an embodiment of the present invention.

1,4 Envelope detecting means
2 Frequency-component detecting means
3 Tempo detecting means
11 Filter unit
12, 41 Pre-processor
13, 42 Envelope generator
21 DC cut unit
22 FFT processor
31 Score calculator
32 Tempo determiner
43 Post-processor
100 Tempo detecting device

Best Modes for Carrying Out the Invention

An embodiment of the present invention will be described hereinafter with reference to the drawings.

FIG. 1 is a view illustrating the schematic structure of a tempo detecting device 100 according to an embodiment of the present invention and the flow of tempo detecting processing thereof. The tempo detecting device 100 is a device for detecting the tempo (BPM: Beat Per Minute) of a musical composition based on a rhythm thereof.

Specifically, the tempo detecting device 100 includes an envelope detecting means 1 for detecting an envelope of a musical composition, such as an envelope of the temporal change in amplitude, and a frequency-component detecting means 2 for detecting frequency components of the detected envelope. The tempo detecting device 100 includes a tempo detecting means 3 for analyzing a peak frequency from the frequency components of the detected envelope to thereby detect the tempo of the musical composition.

A tempo detecting method employed by the tempo detecting device 100 according to this embodiment obtains a temporally repeated structure of the rhythm of a musical composition by detecting an envelope of the musical composition, and performs a Fourier Transform on the obtained temporally repeated structure to thereby calculate the frequency spectrum of the envelope of the musical composition. Then, the tempo detecting method detects the tempo of the musical composition based on the peak frequency of the calculated frequency spectrum. Specifically, the tempo detecting method of the tempo detecting device 100 according to this embodiment is a method for analyzing musical composition data in the frequency domain to thereby detect the tempo.

The envelope detecting means 1 specifically includes a filter unit 11, a pre-processor 12, and an envelope generator 13.

The filter unit 11 has a function of extracting predetermined frequency portions of an inputted music signal. In this embodiment, the filter unit 11 consists of two filters, specifically, a LPF (Low Pass Filter) 11*a* that extracts a low frequency portion of the inputted music signal, and a HPF (High Pass Filter) 11*b* that extracts a high frequency portion thereof. The LPF 11*a* has a cutoff frequency of 200 Hz, and the HPF 11*b* has a cutoff frequency of 2 kHz. These values of the cutoff frequencies are an example, and therefore, other values can be set thereto. Because the rhythm of a musical composition is frequently contained in its low frequency portion and high frequency portion, the filter unit 11 according to this embodiment has a configuration with the LPF 11*a* for extracting the low frequency portion and the HPF 11*b* for detecting the high frequency portion, but can have another configuration. For example, the filter unit 11 can be configured to extract three or more frequency portions, or extract a single frequency portion.

Figure 2:
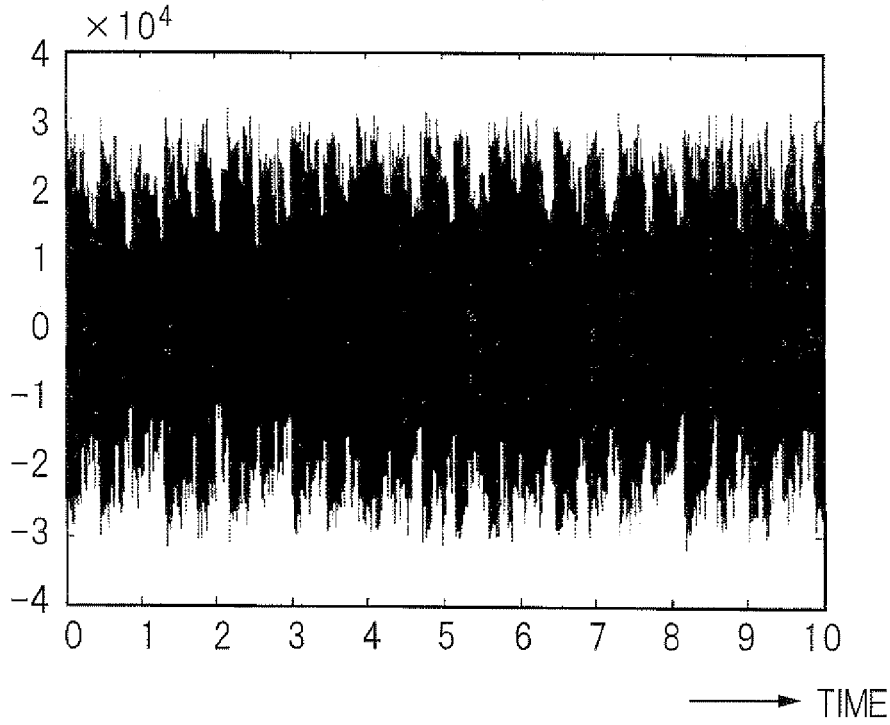
FIG. 2 is a view illustrating an example of the waveform of a music signal inputted to the tempo detecting device according to this embodiment of the present invention.
Figure 3:
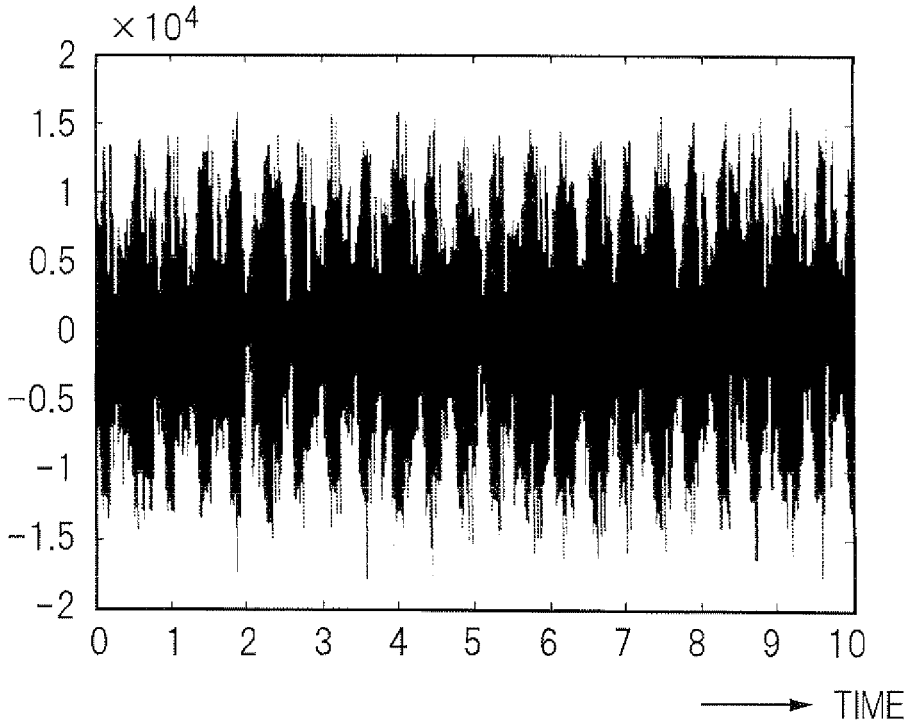
FIG. 3 is a view illustrating an example of the waveform of a low frequency portion extracted by the tempo detecting device according to this embodiment of the present invention.
Figure 4:
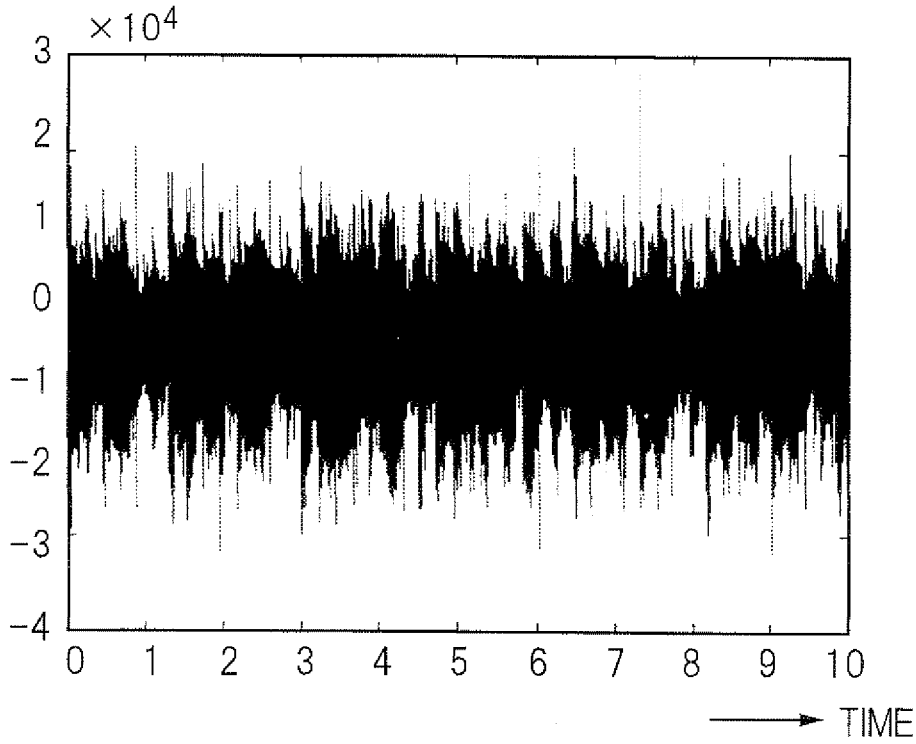
FIG. 4 is a view illustrating an example of the high frequency portion extracted by the tempo detecting device according to this embodiment of the present invention.

FIG. 2 illustrates an example of the waveform of the inputted music signal, FIG. 3 illustrates an example of the low frequency portion extracted by the filter unit 11, and FIG. 4 illustrates an example of the high frequency portion extracted by the filter unit 11.

The pre-processor 12 has a function of: calculating the absolute values of each of the low-frequency music signal and the high-frequency music signal extracted by the filter unit 11, weighting each of the low-frequency music signal and the high-frequency music signal whose absolute values have been calculated, and adding the weighted low-frequency music signal and the high-frequency music signal. Note that the reason why to mix the low-frequency music signal and the high-frequency music signal with each other is to meet the rhythm of a musical composition that has quarter notes in its beat cycle; this musical composition is generated by a low-frequency instrument and a high-frequency instrument.

Figure 5:
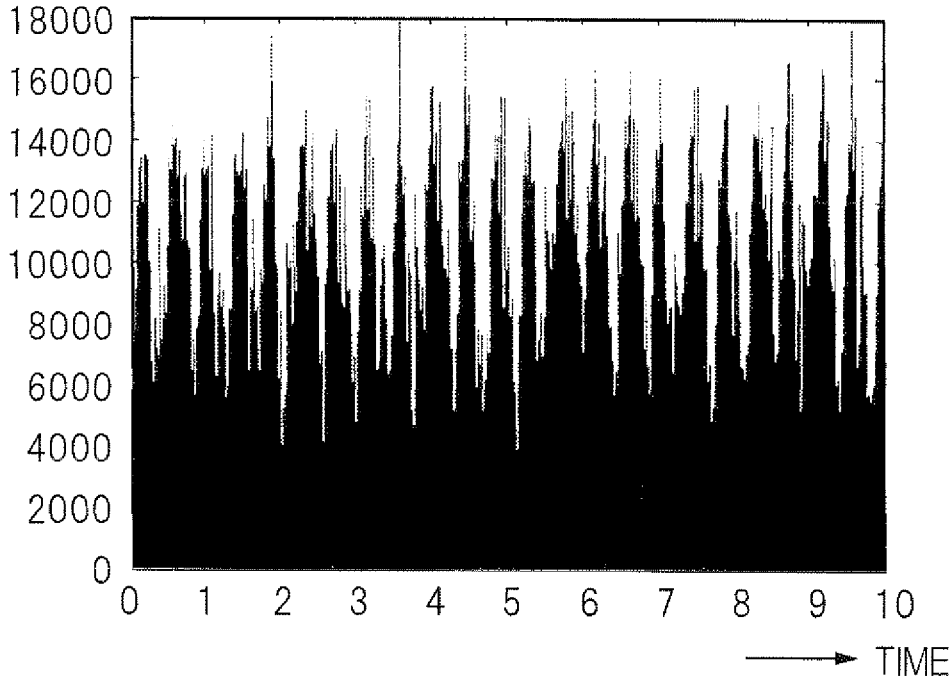
FIG. 5 is a view illustrating an example of the waveform of the signal illustrated in FIG. 3 after calculation of its absolute values.
Figure 6:
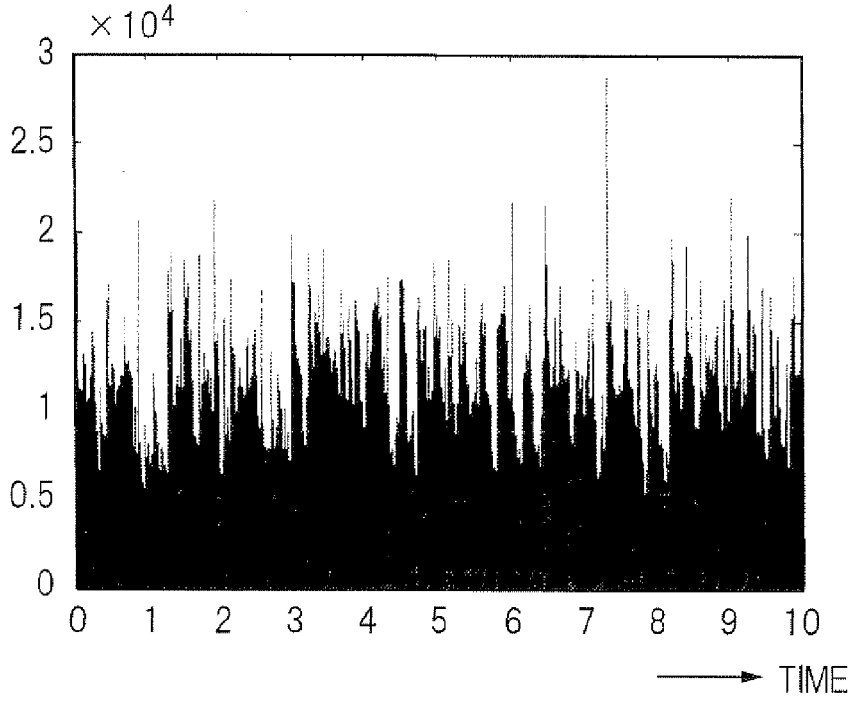
FIG. 6 is a view illustrating an example of the waveform of the signal illustrated in FIG. 4 after calculation of its absolute values.

FIG. 5 illustrates an example of the waveform of the extracted low-frequency music signal after calculation of its absolute values, and FIG. 6 illustrates an example of the waveform of the extracted high-frequency music signal after calculation of its absolute values.

In this embodiment, the level of the low-frequency music signal after calculation of its absolute values is added to that of the high-frequency music signal after calculation of its absolute values in 2:1 weighing ratio. Note that, in this embodiment, the weighting ratio of the low-frequency music signal to the high-frequency music signal is set to 2:1 in order to place an emphasis on the low-frequency music signal, but the weighting ratio of the low-frequency music signal to the high-frequency music signal can be set to another ratio.

Figure 7:
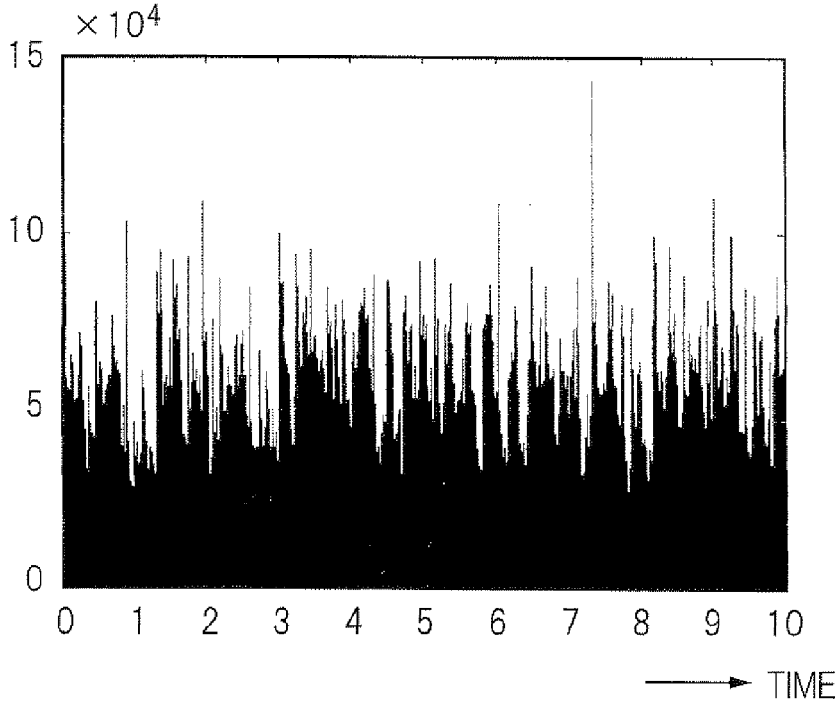
FIG. 7 is a view illustrating the waveform of a music signal obtained by mixing the signal illustrated in FIG. 5 with the signal illustrated in FIG. 6.

FIG. 7 illustrates the waveform of a music signal obtained by adding the weighted low-frequency music signal whose absolute values have been calculated and the weighted high-frequency music signal whose absolute values have been calculated.

The envelope generator 13 has a function of generating an envelope of the music signal generated by the pre-processor 12. Specifically, the envelope generator 13 uses a LPF 13*a* to generate an envelope of the music signal obtained by adding the weighted low-frequency music signal whose absolute values have been calculated and the weighted high-frequency music signal whose absolute values have been calculated.

In this embodiment, the LPF 13*a* has a cutoff frequency of 10 Hz, but the value of the cutoff frequency is an example, and therefore, another value can be set thereto. The envelope generator 13 can generate an envelope of the music signal generated by the pre-processor 12 other than using the LPF 13*a*. For example, the envelope generator 13 can generate an envelope of the music signal generated by the pre-processor 12 by connecting local maximum points on the music signal generated by the pre-processor 12.

Figure 11:
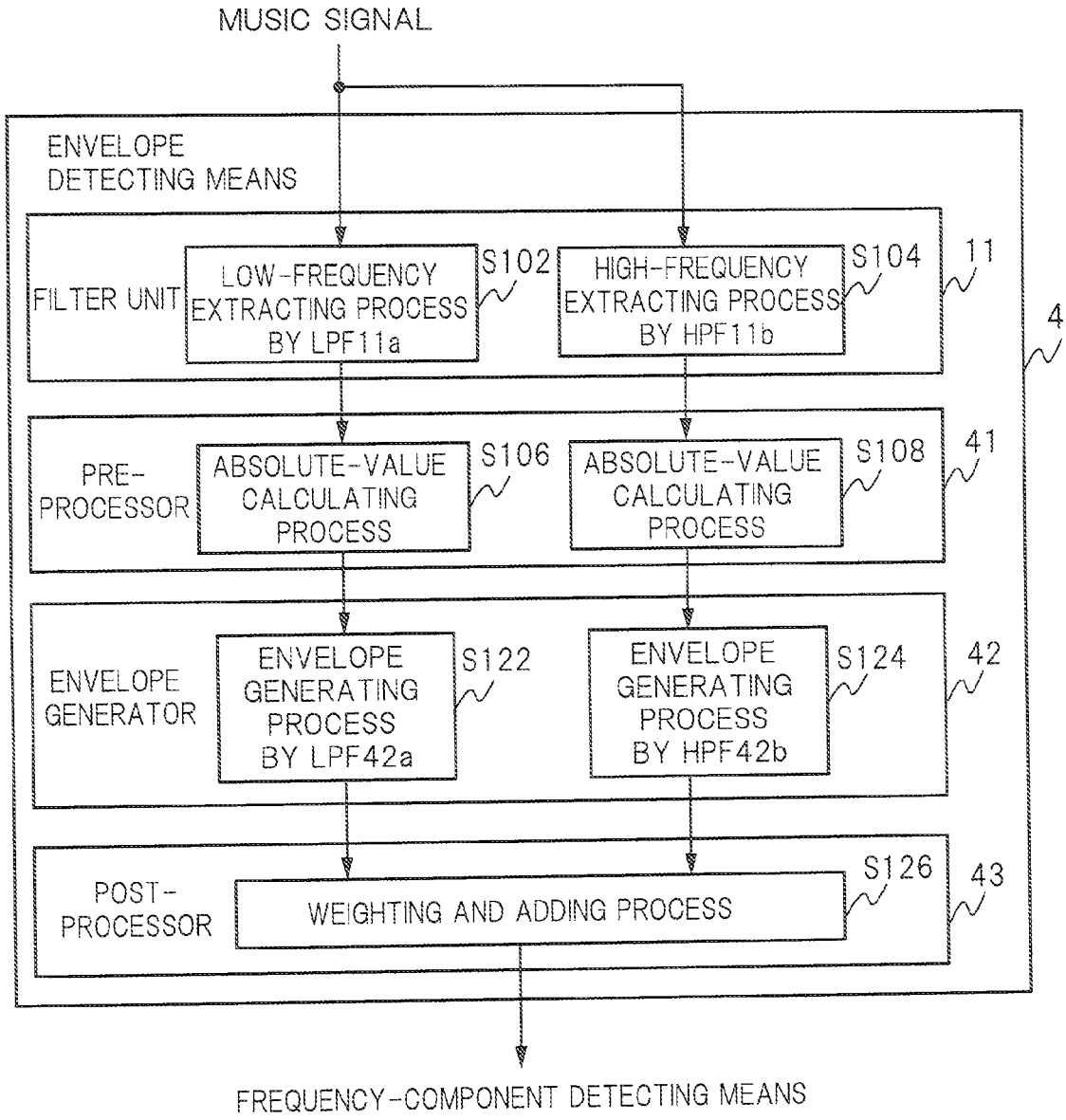
FIG. 11 is a view illustrating a modification of the envelope detecting means of the tempo detecting device according to this embodiment of the present invention.

Note that the envelope detecting means 1 according to this embodiment is configured to add the weighted low-frequency music signal and high-frequency music signal, and thereafter generate an envelope, but can have another configuration. For example, the envelope detecting means 1 can be configured as an envelope detecting means 4 illustrated in FIG. 11. The envelope detecting means 4 includes a filer unit 41, an envelope generator 42, and a post-processor 43. The envelope detecting means 4 is adapted to generate an envelope of the low-frequency music signal whose absolute values have been calculated and an envelope of the high-frequency music signal whose absolute values have been calculated, weight the envelope of the low-frequency music signal and that of the high-frequency music signal, and add the weighted envelope of the low-frequency music signal and the weighted envelope of the high-frequency music signal to thereby generate a single envelope.

The frequency-component detecting means 2 includes a DC cut unit 21 and an FFT processor 22.

The DC cut unit 21 has a function of cutting off DC components in the envelope generated by the envelope generator 13. Specifically, the DC cut unit 21 uses a HPF 21*a* with a low cutoff frequency to eliminate a low-frequency signal. The reason why to eliminate the DC components is that, if the DC components were contained in the envelope, FFT processing applied to the envelope described hereinafter would emphasize a low-frequency portion, which might result in false detection of the tempo. Note that, in this embodiment, the HPF 21*a* has the cutoff frequency of 0.5 Hz, but the value of the cutoff frequency is an example, and therefore, another value can be set thereto.

Figure 8:
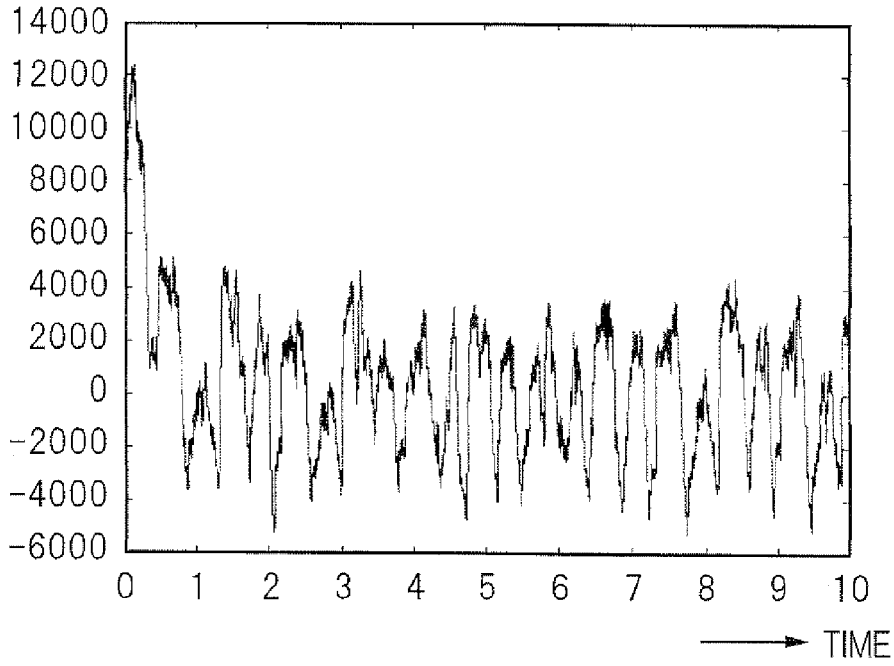
FIG. 8 is a view illustrating the waveform of an envelope of the signal illustrated in FIG. 7 from which the DC components have been eliminated.

FIG. 8 illustrates the waveform of a music signal obtained by cutting off the DC components from the generated envelope.

The FFT processor 22 has a function of performing Fast Fourier Transform (FFT) processing on the envelope waveform from which the DC components have been cut off to thereby calculate a frequency spectrum.

Specifically, the FFT processor 22 performs the FFT processing with the sampling frequency of 50 Hz and 1024 FFT points. That is, the frame length for performing the FFT processing is set to approximately 20.5 seconds substantially equal to 1024/50. Each time 1024 points are buffered (each time 20.5 seconds has elapsed), the FFT is performed so that the absolutes values are calculated. Note that this embodiment is configured to integrate the 1024 points as the FFT points by the FFT processing, but can be configured to subject the whole of the musical composition to the FFT processing. Specifically, because this embodiment performs the FFT processing on the envelope waveform of a music signal at a sampling frequency within a lower frequency range, it is possible to reduce the amount of calculation. For this reason, even if the whole of the musical composition is subjected to the FFT processing, because the FFT processing is not frequently used, it is possible to prevent a burden on the device.

Figure 9:
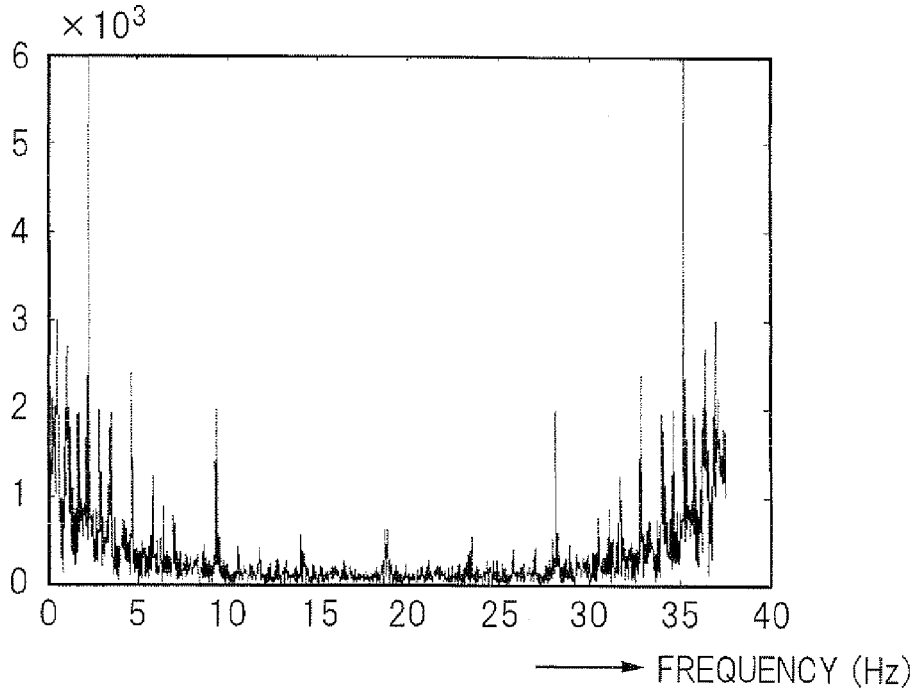
FIG. 9 is a view illustrating a frequency spectrum obtained by performing FFT integration on the signal illustrated in FIG. 8.

FIG. 9 illustrates an example of the frequency spectrum.

The frequency-component detecting means 2 is configured to subject the envelope waveform from which the DC components have been cut off to the FFT processing, but is not limited to the configuration, and therefore, another configuration can be used. For example, the DC components can be eliminated after the FFT processing. In performing the FFT processing, a preset window function can be multiplied to weight the envelope waveform so that the low-frequency portion is eliminated.

The tempo detecting means 3 specifically includes a score calculator 31 and a tempo determiner 32.

The score calculator 31 has a function of analyzing the spectrum obtained by the FFT calculator 32. Specifically, because the tempo of an estimated musical composition is estimated as the range of 1 to 3 Hz, the score calculator 31 searches the frequency range in accordance with a frequency resolution to calculate a score. In this embodiment, the score is calculated by weighting, in addition to a value of the amplitude spectrum at each search point (search frequency), a value of the amplitude spectrum at a point whose frequency is double each search point and a value of the amplitude spectrum at a point whose frequency is the half of each search frequency. Specifically, the weight of the value of the amplitude spectrum at each search point is set to 1, the weight of the value of the amplitude spectrum at the point whose frequency is double each search point is set to 0.5, and the weight of the value of the amplitude spectrum at the point whose frequency is the half of each search point is set to 0.5. These values are added to each other to calculate the score. The score calculation of this embodiment considers the peak of the frequency spectrum obtained by the FFT processor 22, and considers another quadruple measure (half note, eighth note)

Figure 10:
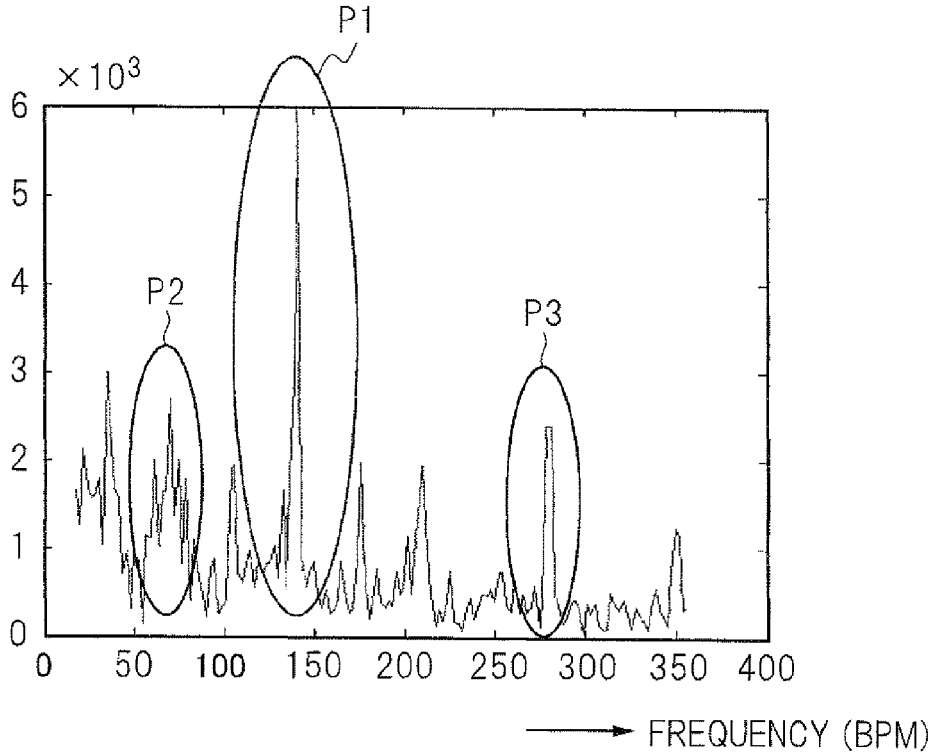
FIG. 10 is a view illustrating an enlarged frequency spectrum of a portion of the spectrum illustrated in FIG. 9; this portion corresponds to the frequency range of 0 to 6 Hz.

FIG. 10 illustrates an enlarged spectrum of a portion of the spectrum illustrated in FIG. 9; this portion corresponds to the frequency range of 0 to 6 Hz. Note that the unit of the horizontal axis is BPM equal to Hz×60. For example, as illustrated in FIG. 10, when a point at 140 BPM close to a peak P1 is set to a search point, in addition to a value of the amplitude spectrum at the 140 BPM, a value of the amplitude spectrum at 280 BPM close to a peak P3 and a value of the amplitude spectrum at 70 BPM close to a peak P2 are considered to calculate the score at the 140 BPM.

Note that this embodiment uses the score calculation method that considers a double and a half of the frequency at each search point, it can use a score calculation method that considers a fourfold, eightfold, . . . , a fourth, an eighth, . . . , of the frequency at each search point. Specifically, as score calculation methods considering musical notes in quadruple measure, a score calculation method considering, in addition to the value of the amplitude spectrum at each search point, values of the amplitude spectrum at frequencies obtained by multiplying the frequency at each search point by $2^N$ and $1/2^N$ (N is a natural number) can be used. In addition to or in place of musical notes in quadruple measure, a score calculation method considering musical notes in triple measure can be used. Specifically, a score calculation method considering, in addition to the value of the amplitude spectrum at each search point, values of the amplitude spectrum at frequencies obtained by multiplying the frequency at each search point by $3^N$ and $1/3^N$ (N is a natural number) can be used.

The tempo detector 32 is adapted to determine, as a tempo frequency, the frequency whose score is the highest in the scores calculated by the score calculator 31, and multiply the determined tempo frequency by 60 to thereby calculate a BPM.

Next, operations of the tempo detecting device 100 according to this embodiment will be described with reference to FIG. 1.

First, the tempo detecting device 100 extracts, by the LPF 11*a*, the low-frequency portion in an inputted music signal in step S102, and extracts, by the HPF 11*b*, the high-frequency portion in the inputted music signal in step S104.

Next, the tempo detecting device 100 calculates the absolute values of the extracted low-frequency music signal in step S106, and calculates the absolute values of the extracted high-frequency music signal in step S108. Then, the tempo detecting device 100 weights each of the low-frequency music signal and the high-frequency music signal whose absolute values have been calculated, and adds the weighted low-frequency music signal and the high-frequency music signal in step S110.

Next, the tempo detecting device 100 generates an envelope of the music signal obtained by the addition based on the LPF 13*a* in step S112.

Subsequently, the tempo detecting device 100 eliminates DC components contained in the generated envelop in step S202, and performs an FFT integration on the envelope from which the DC components have been eliminated in step S204. As a result, the tempo detecting device 100 achieves the frequency spectrum of the music signal.

Next, the tempo detecting device 100 calculates scores from the waveform data of the obtained frequency spectrum within a preset frequency range in consideration of quadruple measure in step S302, and determines, as the tempo, the frequency whose score is the highest in the calculated scores, and converts the determined frequency into a BPM in S304.

Note that, when using the envelope detecting means 4 for generating an envelope, the tempo detecting device 100 generates an envelope for the absolute values of the extracted low-frequency music signal, and generates an envelope for the absolute values of the extracted high-frequency music signal in steps S122 and S124 after the operations in steps S102 to S108. Thereafter, the tempo detecting device 100 weights each of the generated envelopes, and adds the weighted envelopes to thereby generate an envelope.

As described above, the tempo detecting device 100 includes the envelope detecting means 1 for detecting an envelope of musical composition data, the frequency-component detecting means 2 for performing a Fast Fourier Transform on the detected envelope to thereby detect a frequency spectrum, and a tempo detecting means for detecting the tempo based on the characteristics of the detected frequency spectrum. This configuration detects the tempos of various types of musical compositions with high accuracy.

Specifically, the tempo detecting device 100 according to this embodiment extracts the low-frequency portion and the high-frequency portion of an inputted music signal, weights each of the low-frequency and high-frequency music signals, adds the weighted low-frequency and high-frequency music signals to thereby generate an envelope, generates a frequency spectrum of the envelope, and, thereafter, detects the tempo using a score calculating method in consideration of quadruple measure. For this reason, it is possible to accurately detect the tempo of even musical compositions with a weak beat, such as pop songs.

The tempo detecting device 100 according to this embodiment has a light burden of the Fast Fourier Transform processing for generating the frequency spectrum of the envelope. For this reason, the tempo detecting device 100 can be applied for installation.

As a result, an installation of the tempo detecting device 100 in an AV system with a feeling playback function allows some pieces of music meeting feelings, such as "cheerful", "good vibes", and "slow-tempo" to be immediately and properly selected.

Note that the operations of the tempo detecting device 100 according to this embodiment are implemented by execution of a control program stored in the tempo detecting device 100. The control program can be stored in a storage medium, such as a portable flash memory, a CD-ROM, an MO, and a DVD ROM, which can be readable by computers or AV systems. The control program can also be distributed via communication networks.

The embodiment of the present invention have been described, but the present invention is not limited thereto, and it can be subjected to various deformations and modifications within the scope of the present invention. The embodiment with these various deformations and modifications are also within the scope of the present invention.

The invention claimed is:

1. A tempo detecting device comprising:

an envelope detecting means that detects an envelope of musical composition data;

a frequency-component detecting means that performs a discrete Fast Fourier Transform processing on the detected envelope to thereby detect a frequency spectrum; and a tempo detecting means that detects, based on a characteristic of the detected frequency spectrum, a tempo of the musical composition data, wherein the envelope detecting means comprises:

a musical composition data extracting means that extracts at least two frequency-band components of the musical composition data;

an envelope generating means that generates an envelope of each of the frequency-band components extracted by the musical composition data extracting means; and an adding means that weights each of the envelopes generated by the envelope generating means, and adds the weighted envelopes to each other.

2. The tempo detecting device according to claim 1, wherein the envelope detecting means uses a low pass filter (LPF) to thereby generate the envelope.

3. The tempo detecting device according to claim 2, wherein the musical composition data extracting means that obtains absolute values of signal levels of each of the extracted frequency-band components.

4. The tempo detecting device according to claim 2, wherein the frequency-component detecting means comprises:

a DC-component eliminating means that eliminates a DC component contained in the detected envelope; and an FFT means that performs the discrete Fast Fourier Transform processing on the envelope from which the DC component has been eliminated to thereby generate the frequency spectrum.

5. The tempo detecting device according to claim 2, wherein the tempo detecting means comprises:

a score calculating means that searches a predetermined frequency range of the frequency spectrum at preset intervals to calculate a score at each frequency point of the frequency spectrum based on a predetermined operation procedure; and a tempo means that determines, as the tempo, a frequency of the frequency point whose score is the highest in the scores of the frequency points.

6. The tempo detecting device according to claim 1, wherein the musical composition data extracting means that obtains absolute values of signal levels of each of the extracted frequency-band components.

7. The tempo detecting device according to claim 6, wherein the frequency-component detecting means comprises:

a DC-component eliminating means that eliminates a DC component contained in the detected envelope; and an FFT means that performs the discrete Fast Fourier Transform processing on the envelope from which the DC component has been eliminated to thereby generate the frequency spectrum.

8. The tempo detecting device according to claim 6, wherein the tempo detecting means comprises:

a score calculating means that searches a predetermined frequency range of the frequency spectrum at preset intervals to calculate a score at each frequency point of the frequency spectrum based on a predetermined operation procedure; and a tempo means that determines, as the tempo, a frequency of the frequency point whose score is the highest in the scores of the frequency points.

9. The tempo detecting device according to claim 1, wherein the frequency-component detecting means comprises:

a DC-component eliminating means that eliminates a DC component contained in the detected envelope; and an FFT means that performs the discrete Fast Fourier Transform processing on the envelope from which the DC component has been eliminated to thereby generate the frequency spectrum.

10. The tempo detecting device according to claim 9, wherein the tempo detecting means comprises:

a score calculating means that searches a predetermined frequency range of the frequency spectrum at preset intervals to calculate a score at each frequency point of the frequency spectrum based on a predetermined operation procedure; and a tempo means that determines, as the tempo, a frequency of the frequency point whose score is the highest in the scores of the frequency points.

11. The tempo detecting device according to claim 1, wherein the tempo detecting means comprises:

a score calculating means that searches a predetermined frequency range of the frequency spectrum at preset intervals to calculate a score at each frequency point of the frequency spectrum based on a predetermined operation procedure; and a tempo means that determines, as the tempo, a frequency of the frequency point whose score is the highest in the scores of the frequency points.

12. The tempo detecting device according to claim 11, wherein the score calculating means weights a first score that is an amplitude level of each frequency point of the frequency spectrum by a second score that is an amplitude level of a frequency point of the frequency spectrum whose frequency is $2^N$ times the frequency of each frequency point to thereby obtain the weighted first score of each frequency point as the score thereof; the N being a positive or negative integer equal to or greater than 1.

13. The tempo detecting device according to claim 12, wherein the score calculating means weights the weighted first score of each frequency point of the frequency spectrum by a third score that is an amplitude level of a frequency point of the frequency spectrum whose frequency is $3^N$ times the frequency of each frequency point to thereby obtain the weighted score of each frequency point as the score thereof; the N being a positive or negative integer equal to or greater than 1.

14. The tempo detecting device according to claim 11, wherein the score calculating means weights a first score that is an amplitude level of each frequency point of the frequency spectrum by a third score that is an amplitude level of a frequency point of the frequency spectrum whose frequency is $3^N$ times the frequency of each frequency point to thereby obtain the weighted score of each frequency point as the score thereof; the N being a positive or negative integer equal to or greater than 1.

15. A program for detecting a tempo of musical composition data, the program being configured to cause a computer to execute:

an envelope detecting step that detects an envelope of musical composition data;

a frequency-component detecting step that performs a discrete Fast Fourier Transform processing on the detected envelope to thereby detect a frequency spectrum; and a tempo detecting step that detects, based on a characteristic of the detected frequency spectrum, a tempo of the musical composition data, wherein the envelope detecting step comprises:

a musical composition data extracting step that extracts at least two frequency-band components of the musical composition data;

an envelope generating step that generates an envelope of each of the frequency-band components extracted by the musical composition data extracting means; and an adding step that weights each of the envelopes generated by the envelope generating means, and adds the weighted envelopes to each other.

* * * * *